US006730180B1

(12) United States Patent
Mizia et al.

(10) Patent No.: US 6,730,180 B1
(45) Date of Patent: May 4, 2004

(54) NEUTRON ABSORBING ALLOYS

(75) Inventors: Ronald E. Mizia, Idaho Falls, ID (US); Eric L. Shaber, Idaho Falls, ID (US); John N. DuPont, Whitehall, PA (US); Charles V. Robino, Albuquerque, NM (US); David B. Williams, Bethlehem, PA (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 0 days.

(21) Appl. No.: 09/965,946

(22) Filed: Sep. 26, 2001

Related U.S. Application Data

(60) Provisional application No. 60/235,947, filed on Sep. 26, 2000.

(51) Int. Cl.[7] ..... C22C 19/05
(52) U.S. Cl. ..... 148/427; 420/453
(58) Field of Search ..... 148/427; 420/40, 420/57, 443, 453; 976/DIG. 181

(56) References Cited

U.S. PATENT DOCUMENTS

| | | | | | |
|---|---|---|---|---|---|
| 3,362,813 | A | | 1/1968 | Ziolkowski | 75/128 |
| 4,010,375 | A | * | 3/1977 | Wachter et al. | 376/272 |
| 4,210,447 | A | * | 7/1980 | Tsai | 420/443 |
| 4,292,528 | A | * | 9/1981 | Shaffer et al. | 250/506.1 |
| 4,592,890 | A | * | 6/1986 | Burnett et al. | 420/442 |
| 5,334,847 | A | | 8/1994 | Kronberg | 250/506.1 |
| 5,908,486 | A | | 6/1999 | Flinn et al. | 75/232 |
| 5,926,516 | A | * | 7/1999 | Rudnick et al. | 376/272 |
| 6,125,912 | A | | 10/2000 | Branagan et al. | 166/46 |

FOREIGN PATENT DOCUMENTS

| | | | | | |
|---|---|---|---|---|---|
| JP | 62056557 | A | * | 3/1987 | C22C/38/50 |
| JP | 62-056557 | A | * | 12/1987 | C22C/38/50 |
| JP | 06192792 | A | * | 7/1994 | C22C/38/00 |

OTHER PUBLICATIONS

Machine Translation of JP 06–192792 A.*

Metals Handbook, Ninth Edition, vol. 2 Properties and Selection: NonFerrous Alloys and Pure Metals, 1982, p. 713.*

Metals Handbook, Tenth Edition, vol. 1 Properties and Selection: Irons, Steels, and High–Performance Alloys, 1990, pp. 140–141, 210–211, and 842.*

Merriman, A.D. A Dictionary of Metallurgy, 1958. pp. 392–393.*

DuPont, J. N., Robino, C. V., Mizia, R. E, and Branagan, D. J., "Preliminary Microstructural Characterization of Gadolinium–Enriched Stainless Steels for Spent Nuclear Fuel Baskets", pp. 369–378, Jun. 2000.

"Standard Specification for Annealed or Cold–Worked Austenitic Stainless Steel Sheet, Strip, Plate, and Flat Bar", ASTM, Designation: A 666–00, May 2000.

Cole, H.S., "Corrision of Stainless Steel Type 304 Alloyed With Boron or Gadolinium by Plant Process Solutions Containing $HNO_3$ and HF" Prepared by Allied Chemical Corporation for Energy Research and Development Administration, Sep. 1976.

Report 2275, Revision of Jul. 15, 1970, Aerojet Nuclear Systems Company, Aug. 30, 1970.

* cited by examiner

*Primary Examiner*—Roy King
*Assistant Examiner*—Harry D. Wilkins, III
(74) *Attorney, Agent, or Firm*—Trask Britt, P.C.

(57) ABSTRACT

The present invention is drawn to new classes of advanced neutron absorbing structural materials for use in spent nuclear fuel applications requiring structural strength, weldability, and long term corrosion resistance. Particularly, an austenitic stainless steel alloy containing gadolinium and less than 5% of a ferrite content is disclosed. Additionally, a nickel-based alloy containing gadolinium and greater than 50% nickel is also disclosed.

9 Claims, No Drawings

NEUTRON ABSORBING ALLOYS

RELATED APPLICATION

This application claims priority to U.S. Provisional Patent Application Ser. No. 60/235,947, filed Sep. 26, 2001, and is incorporated herein.

CONTRACTUAL ORIGIN OF THE INVENTION

This invention was made with United States Government support under Contract No. DE-AC07-99ID13727 awarded by the United States Department of Energy. The United States Government has certain rights in the invention.

FIELD OF THE INVENTION

The present invention is drawn to new classes of advanced neutron absorbing structural materials for use in spent nuclear fuel applications requiring structural strength, weldability, and long term corrosion resistance.

BACKGROUND OF THE INVENTION

Throughout the world, reliance on nuclear power generation has been increased in recent years due to a corresponding electric power demand increase. Thus, the amount of nuclear fuel elements handled before and after use has also been increased. The reprocessing of Department of Energy (DOE) spent nuclear fuel was discontinued and DOE spent fuel inventories now require long term storage and disposal. Such demand has created a need for materials to be developed which have sufficient thermal neutron absorption ability and sufficient corrosion resistance for uses in the areas of transportation or storage of nuclear fuels.

Structural materials are needed that will absorb thermal neutrons for criticality control in spent nuclear fuel storage systems. These materials preferably should also exhibit excellent corrosion resistance and good weldability. These materials are used to prevent thermal neutrons from initiating an unwanted nuclear chain reaction. Furthermore, for preventing such container materials from undergoing damage by corrosion, it is generally required that the base metals and weld zones of the materials have excellent corrosion resistance.

Austenitic stainless steel, especially stainless steels having a high chromium-nickel composition, have been used as materials for structural members in nuclear reactors because these stainless steel have good corrosion resistance and acceptable mechanical properties. Borated stainless steels have been developed as structural materials for such applications, because boron (B) has a large absorption cross section for thermal neutrons. These stainless steels can be fabricated to be high strength structural neutron absorbing alloys. However, borated stainless steels have limited usefulness because of known metallurgical problems. For example, such materials can be difficult to weld in structural applications.

Hot workability, cold workability, toughness, and weldability are considerations that should be considered when formulating a metal alloy. Gadolinium is known to have a large neutron absorption cross section. In fact, gadolinium has a neutron absorption ability that is more than four times as great as that of boron. Gadolinium (Gd), is a silver-white, malleable, ductile, and lustrous rare-earth metal that is found in gadolinite, monazite, and bastnasite ores. Generally, it is paramagnetic at room temperature but becomes strongly ferromagnetic when cooled. At room temperature, gadolinium crystallizes in the hexagonal, close-packed alpha form. Upon heating to 1235° C., alpha gadolinium transforms into the beta form, which has a body-centered cubic structure.

Because gadolinium has the highest thermal neutron capture cross-section of any known element (about 49,000 barns), attempts have been made to incorporate gadolinium into alloy products for neutron absorbing structural material. For example, in U.S. Pat. No. 3,362,813, a stainless steel alloy containing a minimum of 5% ferrite is disclosed. However, when making a steel product according to the formulas disclosed therein, particularly when using modem steel making techniques, high corrosion resistance is very difficult or impossible to achieve. Additionally, in U.S. Pat. No. 3,615,369, an austenitic stainless steel alloy is disclosed. However, some of the ranges of components disclosed with respect to that composition are not within the useful ranges disclosed herein. Thus, nothing in the prior art appears to teach the compositions disclosed herein, particularly with respect to the low amount of ferrite in the austenitic stainless steel alloys, and with respect to the nickel-based alloys.

SUMMARY OF THE INVENTION

The present invention is drawn to a wrought austenitic stainless steel alloy comprising: a) gadolinium at from about 0.1% to 4% by weight; b) chromium at from about 13% to 18.5% by weight; c) molybdenum at from about 1.5% to 4% by weight; d) manganese at from about 1% to 3% by weight; e) nickel at from about 10% to 23% by weight; f) residual amounts of phosphorus, sulfur, silicon, carbon, and nitrogen; g) a balance of material substantially comprising iron, wherein the ferrite content is less than 5% by weight, and wherein the hot forming range is within from about 800° C. to 950° C. In this temperature range, the alloy is useful for making plate, sheet, strip, bar, and rolled or extruded shapes.

A spent nuclear fuel storage system is also disclosed which is configured for thermal neutron absorption and corrosion resistance. This system comprises a poisoned member being substantially comprised of a cast austenitic stainless steel alloy. The alloy formulation comprises: a) gadolinium at from about 0.1% to 4% by weight; b) chromium at from about 13% to 25% by weight; c) molybdenum at from about 1.5% to 4% by weight; d) manganese at from about 1% to 3% by weight; e) nickel at from about 10% to 25% by weight; f) residual amounts of phosphorus, sulfur, silicon, carbon, and nitrogen; and g) a balance of material substantially comprising iron, and wherein the ferrite content is from about 2% to 25% by weight. Additionally, wrought and cast nickel-based alloys are also disclosed, each comprising: a) gadolinium at from about 0.1% to 10% by weight; b) chromium at from about 13% to 24% by weight; c) molybdenum at from about 1.5% to 16% by weight; d) iron at from about 0.01% to 6% by weight; e) residual amounts of manganese, phosphorus, sulfur, silicon, carbon, and nitrogen; and f) a balance of material substantially comprising nickel wherein the nickel is present at greater than 50% by weight. Furthermore, tungsten may be present in the range from about 0.0% to about 4.0%. In the case of the wrought nickel-based alloys, the alloys should have a hot forming range from about 800° C. to 1200° C. In one embodiment, the iron content can be restricted to from about 0.01% to 3% by weight.

DETAILED DESCRIPTION OF THE INVENTION

Before the present invention is disclosed and described, it is to be understood that this invention is not limited to the particular configurations, process steps and materials disclosed herein as these may vary to some degree. It is also to be understood that the terminology used herein is for the purpose of describing particular embodiments only, and is not intended to be limiting as the scope of the present invention. The invention will be limited only by the appended claims and equivalents thereof.

It must be noted that, as used in this specification and the appended claims, singular forms of "a," "an," and "the" include plural referents unless the content clearly dictates otherwise.

For the purposes of this document, "residual amounts" refers to elements present in the alloy that are not necessarily added components, though the adding of certain small amounts of these elements is not prohibited by the present definition. Typically, residual amounts are less than 1% by weight for each element, such as is the case with phosphorus, sulfur, and silicon. With respect to carbon and nitrogen, less than 0.010% are acceptable levels falling within the present definition. With respect to manganese (in the nickel-based alloys), less than 0.5% is considered a residual amount.

The present invention provides a new class of advanced neutron absorbing structural materials for use in spent nuclear fuel storage applications requiring structural strength, weldability, and long term corrosion resistance.

Because of its tendency to form insoluble precipitates in the presence of groundwater, over time, gadolinium is expected to remain essentially where it is originally placed in repository waste canisters in a geologic repository. This distinction makes it uniquely suitable for criticality control of spent nuclear fuel (SNF) over geologic time when the SNF, the alloy, and/or other engineered materials can eventually oxidize and chemically stabilize back to their original mineral forms. Borated stainless steel has been shown to be inadequate for geologic use because neutron bombardment will eventually reduce its effectiveness as an absorber, and because the solubility of boron in water often results in its transport out of the storage system. Thus, the invention generally pertains to a family of corrosion resistant, gadolinium containing, neutron absorbing, structural alloys for use in nuclear criticality control applications in the nuclear industry.

With this in mind, a wrought austenitic stainless steel alloy is disclosed comprising: a) gadolinium at from about 0.1% to 4% by weight; b) chromium at from about 13% to 18.5% by weight; c) molybdenum at from about 1.5% to 4% by weight; d) manganese at from about 1% to 3% by weight; e) nickel at from about 10% to 25% by weight; f) residual amounts of phosphorus, sulfur, silicon, carbon, and nitrogen; g) a balance of material substantially comprising iron, wherein the ferrite content is less than 5% by weight, and wherein the hot forming range is from about 800° C. to 950° C. In this range, the hot forming processes can be used to make plate, sheet, strip, bar, and rolled or extruded shapes.

In one embodiment, the gadolinium can be present at from 0.1% to 2% by weight; the chromium can be present at from 14% to 18% by weight; the molybdenum can be present at from about 1.5% to 3% by weight; and the manganese can be present at from about 1% to 2% by weight. With this particular formulation, a stainless steel alloy can be formulated for manufacture using conventional stainless steel ingot casting technology and conventional hot forming within the range of 800° C. to 1000° C. to make plate, sheet, strip, bar, and rolled or extruded shapes.

Though the nickel can be present in greater or lesser amounts, in one embodiment, the nickel content can be from about 11% to 15% by weight. Under these parameters, the stainless steel alloy can be formulated for manufacture using conventional stainless steel ingot casting technology and conventional hot forming within the range of 800° C. to 1000° C. This is useful for formation of plate, sheet, strip, bar, rolled or extruded shapes, as well as for welded tubing or pipe.

Additionally, in another embodiment, the gadolinium can be present at from 0.1% to 1.2% by weight. These neutron absorbing alloys are also weldable with retention of at least 30% of base metal room temperature mechanical and impact properties. Additionally, this family can be manufactured using conventional stainless steel ingot casting technology and conventional hot forming within the range of 800° C. to 1000° C., to make plate, sheet, strip, bar, rolled or extruded shapes, and welded tubing or pipe. Because of its retention of structural properties in the welded condition, this alloy group provides sufficient strength and ductility in the welded condition for use in ASME Section III, Division 3 pressure vessels and related code compliant structural components.

In an alternative embodiment, wrought and cast nickel-based alloys are disclosed, which can be used for storage of spent nuclear fuel, comprising: a) gadolinium at from about 0.1% to 10% by weight; b) chromium at from about 13% to 24% by weight; c) molybdenum at from about 1.5% to 16% by weight; d) iron at from about 0.01% to 66% by weight; e) residual amounts of manganese, phosphorus, sulfur, silicon, carbon, and nitrogen; and f) a balance of material substantially comprising nickel wherein the nickel is present at greater than 50% by weight. Furthermore, tungsten may be present in the range from about 0.0% to about 4.0%. In the case of the wrought nickel-based alloy, the composition can have a hot forming range from about 800° C. to 1200° C. In one embodiment, the iron content can be from about 0.01% to 3% by weight. In another embodiment, some of the other members of the alloy can be restricted to more narrow ranges including chromium at from 20% to 24% by weight; and molybdenum at from about 14% to 16% by weight. If desired, the gadolinium can be further restricted to a range from 0.1% to 3.0% or from 0.1% to 2.0% by weight, depending on the desired properties.

In another embodiment, a spent nuclear fuel storage system configured for thermal neutron absorption and corrosion resistance is disclosed. This system comprises a poisoned member that is substantially comprised of a cast austenitic stainless steel alloy. The cast alloy comprises: a) gadolinium at from about 0.1% to 4% by weight; b) chromium at from about 13% to 25% by weight; c) molybdenum at from about 1.5% to 4% by weight; d) manganese at from about 1% to 3% by weight; e) nickel at from about 10% to 25% by weight; f) residual amounts of phosphorus, sulfur, silicon, carbon, and nitrogen; and g) a balance of material substantially comprising iron. In this embodiment, the ferrite content is preferably from about 2% to 25% by weight. The poisoned member can be an internal or a basket for insertion into spent nuclear fuel, and/or can be an exterior barrier, e.g., a cannister, that contains the internal(s).

A gadolinium-containing metal alloy for neutron absorption is also disclosed comprising: a) gadolinium at from about 0.1% to 10% by weight; b) chromium at from about 13% to 18.5% by weight; c) molybdenum at from about 1.5% to 16% by weight; d) manganese at from residual amounts to about 3% by weight; e) nickel at from about 10% to 85% by weight; f) residual amounts of phosphorus, sulfur, sillicon, carbon, and nitrogen; g) a ferrite content of less than 5% by weight; and h) a balance of material substantially comprising iron, and wherein the alloy is formulated to prevent liquation of gadolinium compounds and cracking at temperatures from about 800° C. to 1200° C. In one preferred embodiment, the nickel can be present at from about 50% to 85% by weight. In another preferred embodiment, the nickel can be present at from about 10% to 23% by weight.

Any of the compositions described herein can be used for a variety of purposes within the area of spent nuclear fuel storage. For example, these alloys can be used for Department of Energy (DOE) standardized canisters. These alloys can also be used as internals Appropriately configured internals can include tubes, blocks or squares, baskets, or an array of grids, to name a few.

EXAMPLES

The following examples should not be considered as limitations of the present invention, but are merely intended to teach how to make the best known alloys based upon current experimental data.

Example 1

Large scale heats were produced in a vacuum induction melting (VI) furnace (36 inch diameter by 30 inch deep). The vacuum chamber was made of a double walled stainless steel water rocket, and the pumping system consisted of a 53 cubic feet per minute (cfm) mechanical pump and a 6 inch diffusion pump. The vacuum induction melting furnace contained a high purity alumina crucible (99%) and was powered by a 20 KW inductotherm power source. A new crucible was installed and outgassed prior to production, and all the raw materials were loaded in the crucible. For gadolinium (Gd) levels below 1 wt %, the Gadolinium was placed in one of the two pour cups above the crucible for late addition to the melt to minimize loss in the final alloy (due to any reaction with the crucible wall).

The chamber was pumped down to below 0.00005 torr using the diffusion pump. Next, the chamber was back-filled with argon (up to ⅓ atmosphere) and pumped down to high vacuum. The chamber was then back-filled again with argon to ⅓ of full atmosphere. The power was gradually turned on and increased to begin melting. Next, the temperature was measured by an optical pyrometer through a quartz view port. Once the charge was fully molten and homogenized, gadolinium was poured into the crucible from a top pour cup (for Gd levels < 1 wt %). Once the gadolinium was homogenized in the melt, the melt was quickly poured by tilting the furnace into a ceramic tundish set over a steel mold with a rectangular cavity. A 4 inch rectangular ingot alloy with a 6 inch hot top was formed. After the mold cooled to ambient temperature, the vacuum chamber was unlocked and the mold removed from the chamber. At this point, the crucible can be cleaned and reloaded with another batch of charges.

Example 2

The same procedure was followed for producing alloys containing gadolinium in excess of 1% by utilizing all of the same raw materials including gadolinium. However, the gadolinium was loaded into the crucible from the onset of the melting cycle rather than at a later pint in time as described in Example 1.

Table 1 illustrates target composition for each alloy prepared. Table 2 below illustrates the actual composition prepared for each alloy. Alloy 1, 2, and 3 were prepared in accordance with Example 1 and alloy 4, 5, and 6 were prepared in accordance with Example 2.

TABLE 1

Target compositions for large scale heats (values in weight percent)

| Alloy | Fe | Ni | Cr | Mo | Mn | Si | Gd |
|---|---|---|---|---|---|---|---|
| 1 | Balance | 11.50 | 16.75 | 2.85 | 1.75 | 0.10 | 0 |
| 2 | Balance | 11.65 | 16.63 | 2.83 | 1.73 | 0.10 | 0.4 |
| 3 | Balance | 11.88 | 16.45 | 2.80 | 1.71 | 0.11 | 1 |
| 4 | Balance | 12.26 | 16.16 | 2.74 | 1.67 | 0.11 | 2 |
| 5 | Balance | 13.03 | 15.56 | 2.63 | 1.60 | 0.13 | 4 |
| 6 | Balance | 13.79 | 14.97 | 2.52 | 1.52 | 0.14 | 6 |

TABLE 2

Actual large scale heat compositions (values in weight percent)

| Alloy | Fe | Ni | Cr | Mo | Mn | Si | Gd | P | S | O | N | C |
|---|---|---|---|---|---|---|---|---|---|---|---|---|
| 1 | Balance | 11.52 | 16.64 | 2.76 | 1.73 | 0.12 | <0.10 | <0.001 | 0.002 | 0.012 | 0.009 | 0.005 |
| 2 | Balance | 11.66 | 16.52 | 2.70 | 1.70 | 0.14 | 0.45 | <0.001 | <0.001 | 0.010 | 0.009 | 0.008 |
| 3 | Balance | 11.94 | 16.30 | 2.63 | 1.69 | 0.10 | 1.08 | <0.001 | <0.001 | 0.007 | 0.008 | 0.012 |
| 4 | Balance | 12.22 | 16.12 | 2.74 | 1.60 | 0.09 | 1.89 | <0.001 | <0.001 | 0.012 | 0.001 | 0.008 |
| 5 | Balance | 13.06 | 15.30 | 2.50 | 1.55 | 0.17 | 4.00 | <0.001 | <0.001 | 0.009 | 0.001 | 0.006 |
| 6 | Balance | 13.86 | 14.69 | 2.38 | 1.48 | 0.18 | 5.84 | <0.001 | <0.001 | 0.017 | 0.001 | 0.005 |

Example 3

A small scale cast nickel based alloy was produced in a vacuum induction melting (VIM) furnace (36 inch diameter by 30 inch deep). The vacuum chamber was made of a double walled stainless steel water rocket, and the pumping system consisted of a 53 cubic feet per minute (cfm) mechanical pump and a 6 inch diffusion pump. The vacuum induction melting furnace contained a high purity alumina crucible (99%) and was powered by a 20 KW inductotherm power source. A new crucible was installed and outgassed prior to production, and all the raw materials were loaded in the crucible. A target composition having 2% gadolinium and greater than 50% nickel was calculated (exact target values set forth in Table 3 below). The chamber was pumped down to below 0.00005 torr using the diffusion pump. Next, the chamber was back-filled with argon (up to ⅓ atmosphere) and pumped down to high vacuum. The chamber was then back-filled again with argon to ⅓ of full atmosphere. The power was gradually turned on and increased to begin melting. Next, the temperature was measured by an optical pyrometer through a quartz view port. Once the gadolinium was homogenized in the melt, the melt was quickly poured by tilting the furnace into a ceramic tundish set over a steel mold with a rectangular cavity. A 4 inch rectangular ingot alloy with a 6 inch hot top was formed. After the mold cooled to ambient temperature, the vacuum chamber was unlocked and the mold removed from the chamber. At this point, the crucible can be cleaned and reloaded with another batch of charges.

Table 3 illustrates the target composition for the nickel-based alloy that was prepared according to steps of Example 3. Manganese (Mn) and silicon (Si) are represented in Table 3 as maximum amounts rather than actual targets. Table 4 illustrates the actual composition prepared for the nickel-based alloy.

TABLE 3

Target compositions for small scale heats (values in weight percent)

| Alloy | Ni | Cr | Mo | Mn | Si | Gd | Fe | P | S | O | N | C |
|---|---|---|---|---|---|---|---|---|---|---|---|---|
| Ni Based | Balance | 20.9 | 12.5 | 0.5 | 0.08 | 2.0 | 2.8 | <0.001 | 0.002 | 0.012 | 0.009 | 0.005 |

While the invention has been described with reference to certain preferred embodiments, those skilled in the art will appreciate that various modifications, changes, omissions and substitutions can be made without departing from the spirit of the invention. It is intended, therefore, that the invention be limited only by the following claims construed as broadly as applicable law allows including all proper equivalents thereof.

We claim:

1. A nickel-based alloy comprising:

gadolinium at from about 0.1% to 10% by weight;

chromium at from about 13% to 24% by weight;

molybdenum at from about 1.5% to 16% by weight;

iron at from about 0.01% to 6% by weight;

residual amounts of manganese, phosphorus, sulfur, silicon, carbon, and nitrogen;

a balance of material substantially comprising nickel; and the nickel-based alloy being in a wrought state.

2. A nickel-based alloy as in claim 1 wherein the iron is present at from about 0.01% to 3% by weight.

3. A nickel-based alloy as in claim 1 wherein the chromium is present at from 20% to 24% by weight, and the molybdenum is present at from about 14% to 16% by weight.

4. A nickel-based alloy as in claim 1 wherein the gadolinium is present at from about 0.1% to 3% by weight.

5. A nickel-based alloy as in claim 1 wherein the nickel-based alloy is configured as an internal.

6. A nickel-based alloy as in claim 1 wherein the nickel-based alloy is configured as a canister.

7. A nickel-based alloy comprising:

gadolinium at from about 0.1% to 10% by weight;

chromium at from about 20% to 24% by weight;

molybdenum at from about 14% to 16% by weight;

iron at from about 0.01 to 6% by weight;

residual amounts of manganese, phosphorus, sulfur, silicon, carbon, and nitrogen; and a balance of material substantially comprising nickel wherein the nickel is present at greater than 50% by weight.

8. A nickel-based alloy comprising:

gadolinium at from about 0.1% to 10% by weight;

chromium at from about 13% to 24% by weight;

molybdenum at from about 1.5% to 16% by weight;

iron at from about 0.01 to 6% by weight;

residual amounts of manganese, phosphorus, sulfur, silicon, carbon, and nitrogen; and a balance of material substantially comprising nickel wherein the nickel is present at greater than 50% by weight, wherein the nickel-based alloy is configured as an internal.

9. A nickel-based alloy comprising:

gadolinium at from about 0.1% to 10% by weight;

chromium at from about 13% to 24% by weight;

molybdenum at from about 1.5% to 16% by weight;

iron at from about 0.01 to 6% by weight;

residual amounts of manganese, phosphorus sulfur, silicon, carbon, and nitrogen; and a balance of material substantially comprising nickel wherein the nickel is present at greater than 50% by weight, wherein the nickel-based alloy is configured as a canister.

* * * * *